US007451889B2

(12) United States Patent
Mantis

(10) Patent No.: US 7,451,889 B2
(45) Date of Patent: Nov. 18, 2008

(54) CARRY-OUT FOOD CONTAINER

(76) Inventor: Lee Mantis, 5512 Amity Pl., Charlotte, NC (US) 28212

( * ) Notice: Subject to any disclaimer, the term of this patent is extended or adjusted under 35 U.S.C. 154(b) by 642 days.

(21) Appl. No.: 10/758,754

(22) Filed: Jan. 16, 2004

(65) Prior Publication Data

US 2005/0155966 A1 Jul. 21, 2005

(51) Int. Cl.
*B65D 25/04* (2006.01)

(52) U.S. Cl. ..... 220/530; 220/529

(58) Field of Classification Search ..... None
See application file for complete search history.

(56) References Cited

U.S. PATENT DOCUMENTS 3,765,595 A * 10/1973 Bernhardt ..... 229/125.08
D254,776 S 4/1980 Edwards
4,241,863 A * 12/1980 Faller ..... 229/120.03
D270,708 S 9/1983 Dart
D277,167 S 1/1985 Dart
4,856,666 A * 8/1989 Easley ..... 215/272
4,962,849 A * 10/1990 Anderson ..... 206/45.24
5,758,794 A 6/1998 Rider, Jr. et al.
5,762,231 A 6/1998 Rider, Jr. et al.
5,899,333 A * 5/1999 Williams et al. ..... 206/469
5,938,068 A 8/1999 Atkins et al.
6,102,231 A 8/2000 Rider, Jr. et al.
D467,496 S 12/2002 Hayes et al.

OTHER PUBLICATIONS

GENPAK, Hinged (Dinner) Containers, pp. 1-3, published prior to Jan. 16, 2004.
GENPAK, Hinged (Sandwich & Snack) Containers, pp. 1-3, published prior to Jan. 16, 2004.
DART, Foam Hinged Containers, pp. 1-3, published prior to Jan. 16, 2004.
PACTIV, Conventional Hinged Containers, p. 1, published prior to Jan. 16, 2004.
PACTIV, Double Laminated Hinged Containers, p. 1, published prior to Jan. 16, 2004.
PACTIV, Black Hinged Containers, p. 1, published prior to Jan. 16, 2004.
PACTIV, SmartLock Hinged Containers, p. 1, published prior to Jan. 16, 2004.
SYSCO, Serene Foam Hinged Containers, p. 1, published prior to Jan. 16, 2004.
LINPAC, Hot Food Boxes and Trays, pp. 1-2, published prior to Jan. 16, 2004.

* cited by examiner

*Primary Examiner*—Stephen J. Castellano
(74) *Attorney, Agent, or Firm*—Schwartz Law Firm P.C.

(57) ABSTRACT

A carry-out food container includes a food compartment tray adapted for holding a food item, and a lid for removably covering the food item contained in the tray. An integrally-formed hinge interconnects the tray and the lid at a joined side edge. The hinge enables pivoting movement of the lid relative to the tray between an open position and a closed position. A flexible sheet is attached adjacent the hinge and is adapted for residing between the tray and the lid.

8 Claims, 5 Drawing Sheets

CARRY-OUT FOOD CONTAINER

TECHNICAL FIELD AND BACKGROUND OF THE INVENTION

This invention relates to an improved carry-out food container, such as that commonly used in the restaurant industry to hold food items prepared for customer pick-up or delivery. Most, if not all, restaurants use carry-out containers to service customers who want to take their food "to-go." One category of widely-used carry-out containers are foam hinged containers. They are made in different shapes and sizes to accommodate room for sandwiches, hot dogs, dinner meals, etc.

When a carry-out order is prepared, items such as plastic utensils, salt, pepper, ketchup, butter and cracker packs, and bread are usually included. Restaurant employees tend to toss these items in the bag or place them in a separate container. At times, they may even forget to include these items. For a customer, the process of searching to find these items can be inconvenient. There are many cases where they even get lost. To avoid this, there are restaurants that make their employees place the food in the container, cover the food with a sheet of dry wax paper, and place these items over the wax paper. When the customer opens the box, everything he or she needs is right there. The food is kept warmer, and the chances of foreign objects falling in it are decreased. In essence, it further protects the food. Also, the cost of using a separate container to store these items can be saved. In some cases, restaurant employees may use aluminum foil instead of wax paper. However, aluminum foil is not entirely microwave safe, and wax paper is.

Restaurant employees that use wax paper for take-out orders still run into problems. The process of finding the wax paper and making sure it is placed neatly over the food can be time-consuming and inconvenient. At times, a restaurant employee may need to go back and forth throughout the kitchen to find wax paper. He or she may even run out of wax paper and have to go to the stock room to get some more. These become significant problems when the restaurant gets busy. The present invention addresses these problems by providing a carry-out container where the wax paper is already attached. This saves the employee time, and it can save the restaurant wax paper or aluminum foil costs. It can also serve as a way for an employee to pay closer attention to the amount of food that is placed in the container, which can also save costs. Furthermore, it increases the likelihood of an employee making sure that all items that need to come with a take-out order are there. The process of covering the food becomes more effective, and the overall appearance of the carry-out container is enhanced. These factors create a situation where the customer is satisfied and will likely come back. Overall, the invention makes the take-out process more smooth and efficient, and all restaurants can really benefit from it.

SUMMARY OF INVENTION

Therefore, it is an object of the invention to provide a carry-out food container which conveniently stores and separates items, such as plastic utensils, salt, pepper, ketchup packs, bread, etc. from food items located in the container.

It is another object of the invention to provide a carry-out food container which keeps food warmer, and reduces the chances of any foreign objects falling into the food.

It is another object of the invention to provide a carry-out food container which is entirely microwave safe.

It is another object of the invention to provide a carry-out food container which facilitates the process of placing wax paper over the food items located in the container.

It is another object of the invention to provide a carry-out food container which is convenient and easy to use.

It is another object of the invention to provide a carry-out food container which increases the production and efficiency of restaurant workers.

It is another object of the invention to provide a carry-out food container which provides complete coverage of wax paper over the food items.

It is another object of the invention to provide a carry-out food container which guards against leaking and keeps its shape when holding your take-out meal.

It is another object of the invention to provide a carry-out food container which helps keeps hot food hot and cold food cold.

It is another object of the invention to provide a carry-out food container which keeps your food items fresh and intact.

It is another object of the invention to provide a carry-out food container which offers the combination of strength, lightness and durability.

These and other objects of the present invention are achieved in the preferred embodiments disclosed below by providing a carry-out food container. The container includes a food compartment tray adapted for holding a food item, and a lid for removably covering the food item contained in the tray. An integrally-formed hinge interconnects the tray and the lid at a common side edge. The hinge enables pivoting movement of the lid relative to the tray between an open position and a closed position. A flexible sheet is attached adjacent the hinge and is adapted for residing between the tray and the lid.

According to another preferred embodiment, the tray and lid are constructed of polystyrene.

According to another preferred embodiment, the tray defines a plurality of divided food compartments.

Preferably, the flexible sheet is dry wax paper.

According to another preferred embodiment, the flexible sheet is attached along a length of the integrally-formed hinge.

According to another preferred embodiment, the flexible sheet defines a perforated tear line extending from one side edge of the sheet to an opposite side edge of the sheet.

According to another preferred embodiment, a starter nick is formed at a leading end of the perforated tear line.

According to another preferred embodiment, the flexible sheet has a length and width dimension greater than a length and width dimension of the food compartment tray.

According to another preferred embodiment, the lid and tray have a complementary locking tab and slot, respectively, adapted for holding the lid in the closed position.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
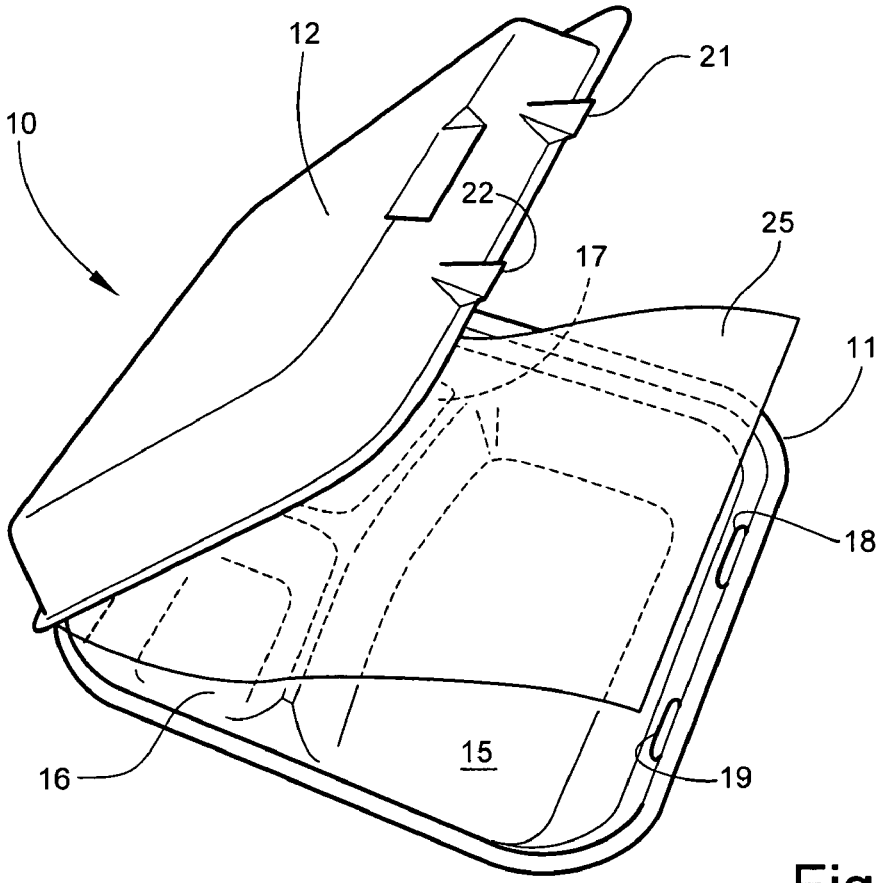
FIG. 1 is a perspective view of a carry-out food container according to one preferred embodiment of the present invention.

Referring now specifically to the drawings, a carry-out food container according to the present invention is illustrated in FIG. 1, and shown generally at reference numeral 10. The food container 10 is especially applicable for use in the restaurant industry for holding food items "F" (See FIG. 3) prepared for customer pick-up and delivery. The container 10 resembles a conventional, polystyrene foam, hinged-lid box commonly available in 8×8 or 9×9 sizes with small, medium, and large size tray wells. When using such boxes, the restaurant worker will generally place a separate sheet of dry wax paper or other covering over the food items, as described above, prior to closing the box and presenting it to the customer. The wax paper is typically stored in roll form or in a box dispenser containing pre-cut sheets. The process of retrieving the wax paper and properly arranging it over the food items "F" is generally time consuming and inconvenient.

Like conventional prior art boxes, the present food container 10 has a tray 11 and lid 12 interconnected by an integral (or "living") hinge 14 formed along a joined side edge. The hinge 14 enables pivoting movement of the lid 12 between an open position and a closed position relative to the tray 11. The tray 11 defines multiple compartments 15, 16, and 17 for separating the food items "F", and slots 18 and 19 adapted for receiving locking tabs 21 and 22 projecting from a front edge of the lid 12. The tabs 21, 22 insert into the corresponding tray slots 18, 19 to releasably hold the lid 12 in the closed position shown in FIG. 3. Preferably, the tray 11 is double laminated for maximum heat tolerance and strength.

Figure 2:
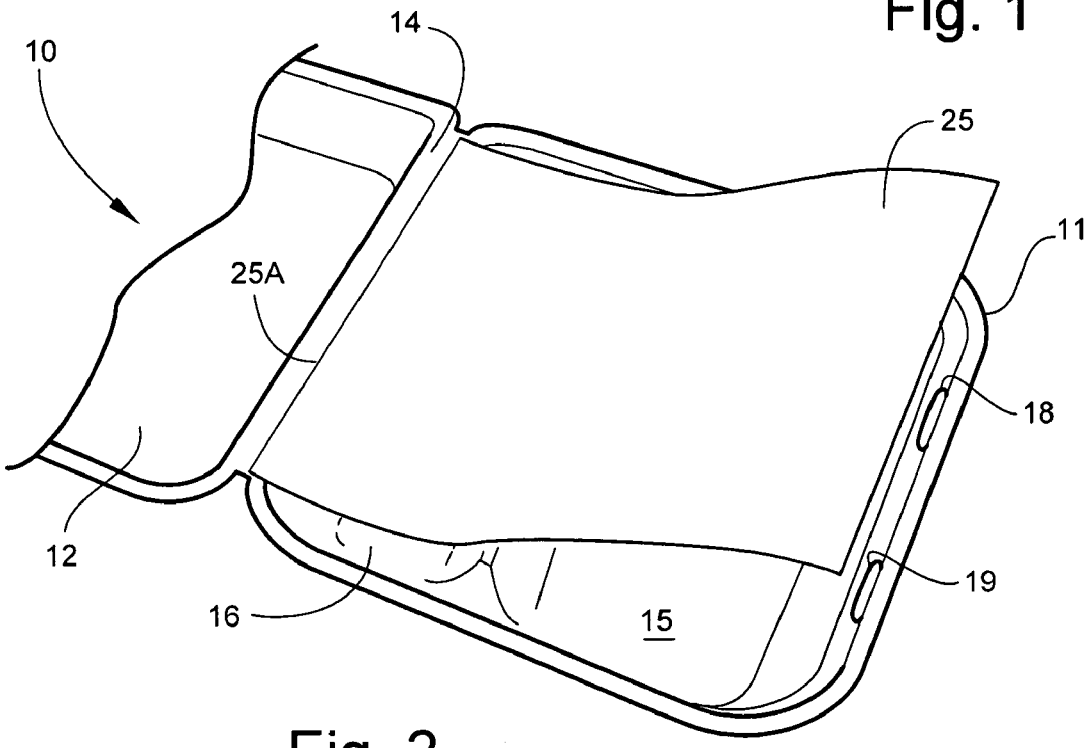
FIG. 2 is a fragmentary view of the food container in an open position showing attachment of the wax paper sheet to the compartment tray.
Figures 3, 4:
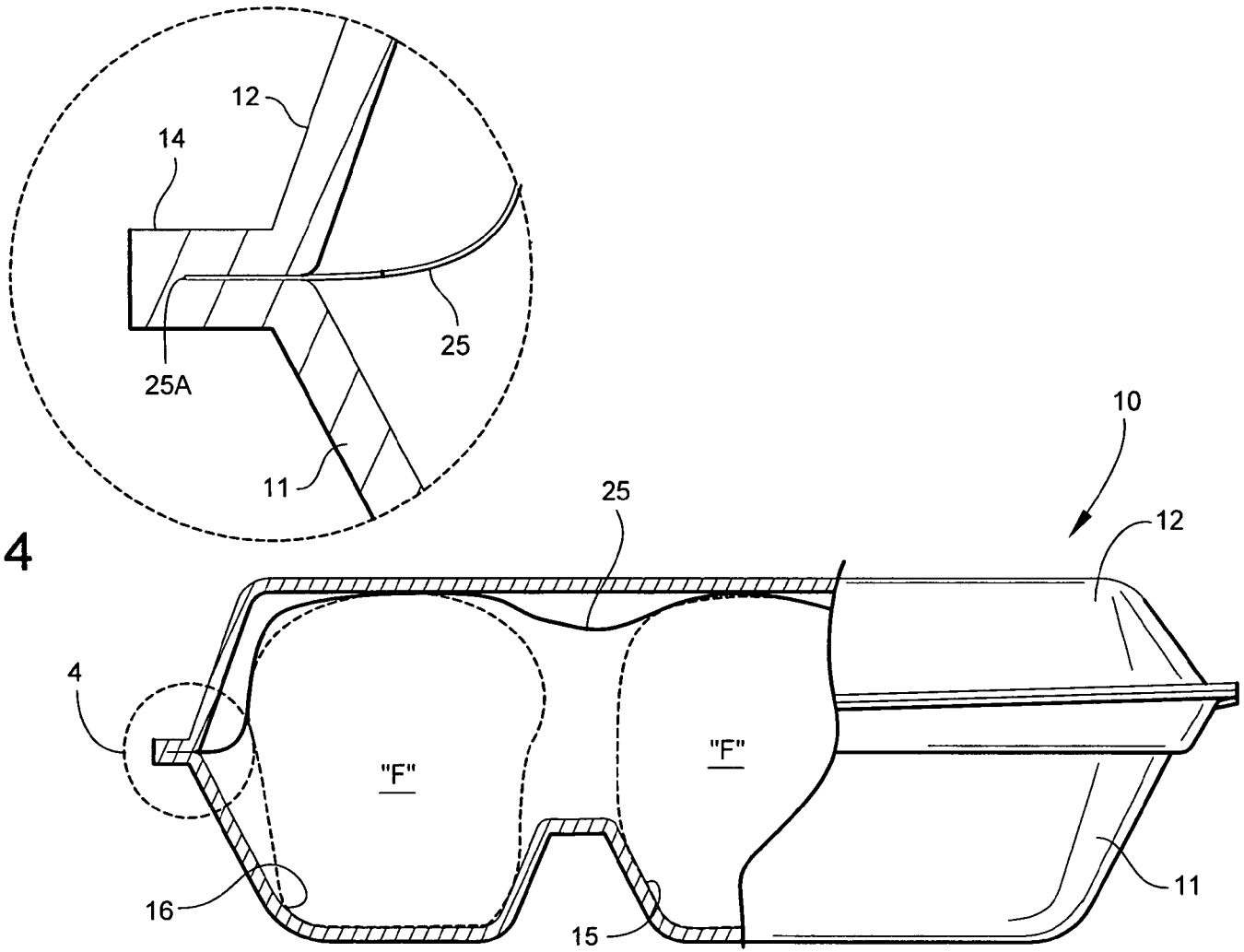
FIG. 3 a cross-sectional view of the food container in the closed position.
FIG. 4 is an enlarged view showing a portion of the food container indicated at numeral 4 in FIG. 3.

A flexible sheet 25 of dry wax paper is attached at the hinge 14, as best shown in FIGS. 2, 3 and 4. The sheet 25 is designed to lay in a precisely spread condition over the food items "F", and to remain in position after the lid 12 is closed and during transport of the container 10. Preferably, the sheet 25 has a length and width dimension slightly larger than the length and width of the tray 11 to ensure complete and proper coverage of the food items "F". The sheet 25 is attached along its rear edge 25A by any suitable means including, but not limited to, a contact adhesive, adhesive tape, or ultrasonic welding. When the container 10 is opened, the customer lifts the sheet 25 to uncover the food items "F". The sheet 25 insulates the container 10, and helps maintain the various food items "F" in their designated compartments 15, 16, and 17.

Figure 5:
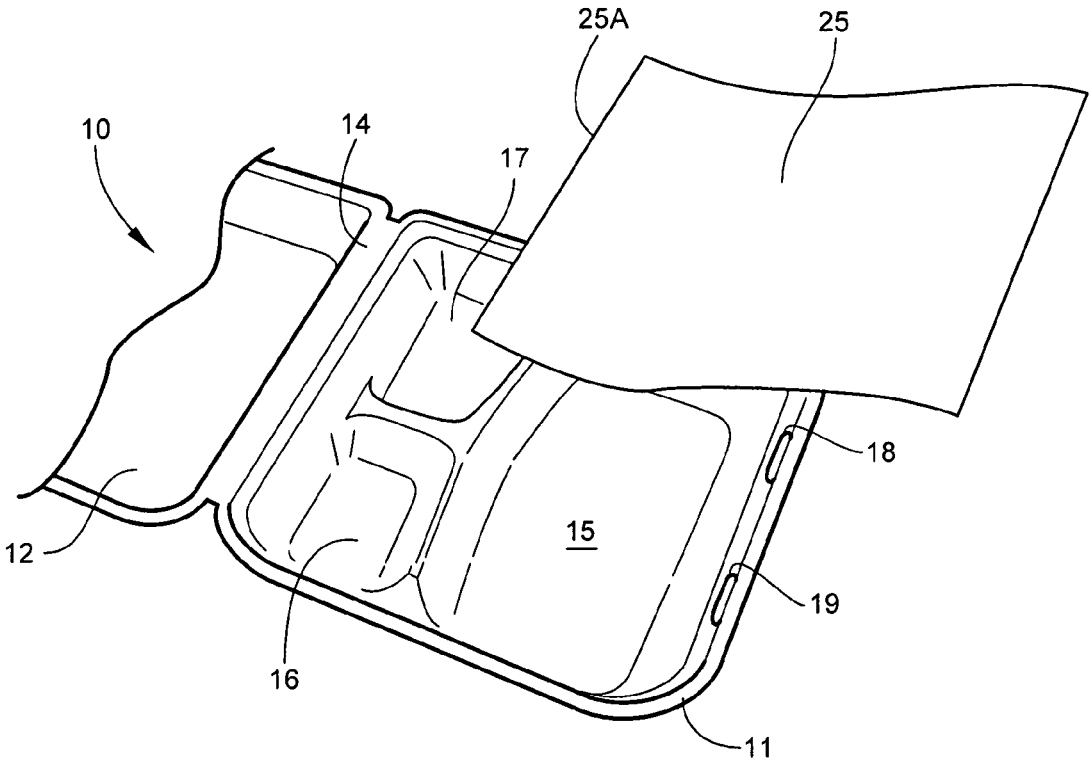
FIG. 5 is a perspective view showing the wax paper sheet entirely removed from the compartment tray.
Figure 6:
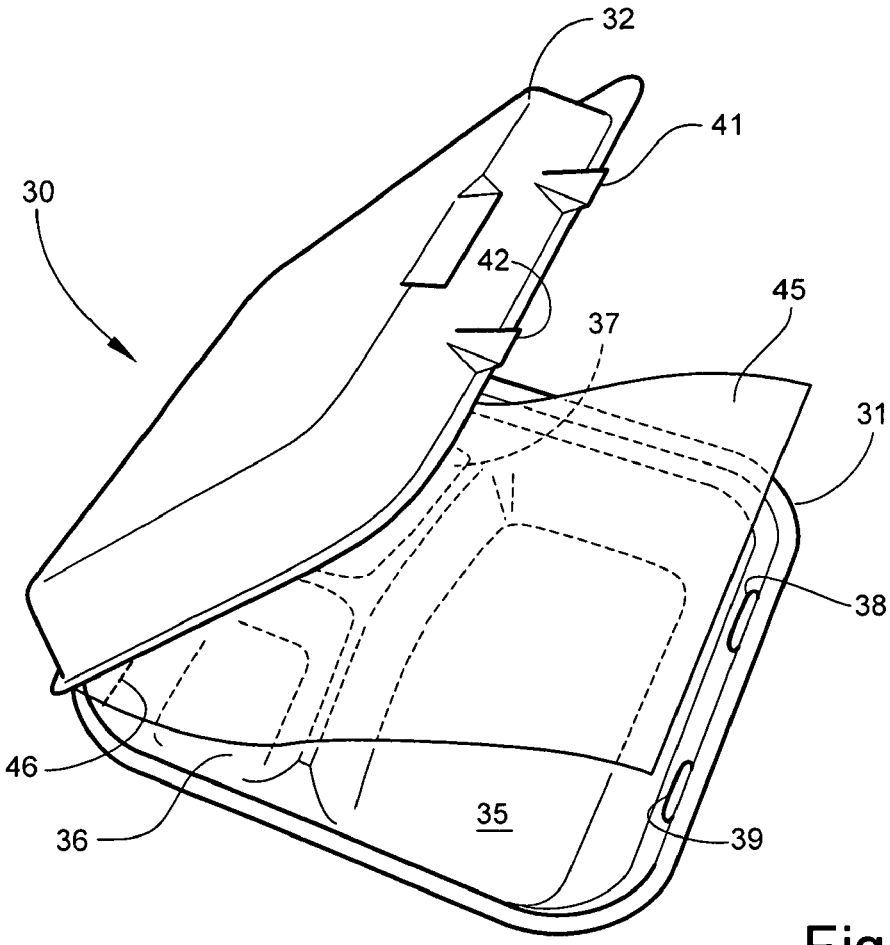
FIG. 6 is a perspective view of a carry-out food container according to a second preferred embodiment of the invention.

For relatively large food items "F" which may be difficult to cover, the sheet 25 may be readily removed at its rear edge 25A from the compartment tray 11, as shown in FIG. 5. In this case, the attachment strength of the sheet 25 to the tray 11 is sufficiently strong to prevent inadvertent removal the sheet 25 when folding over to cover the food items "F", but sufficiently weak to allow intentional removal of the sheet 25 from the tray 11 without tearing.

A further embodiment of a carry-out food container 30 according to the present invention is shown in FIGS. 6-9. Like container 10, the container 30 has a tray 31 and lid 32 interconnected by an integral hinge 34 formed along a joined side edge. The tray 31 defines multiple compartments 35, 36, and 37 for separating the food items, and slots 38 and 39 adapted for receiving locking tabs 41 and 42 projecting from a front edge of the lid 32. The tabs 41, 42 insert into the corresponding tray slots 38, 39 to releasably hold the lid 32 in the closed position.

Figure 7:
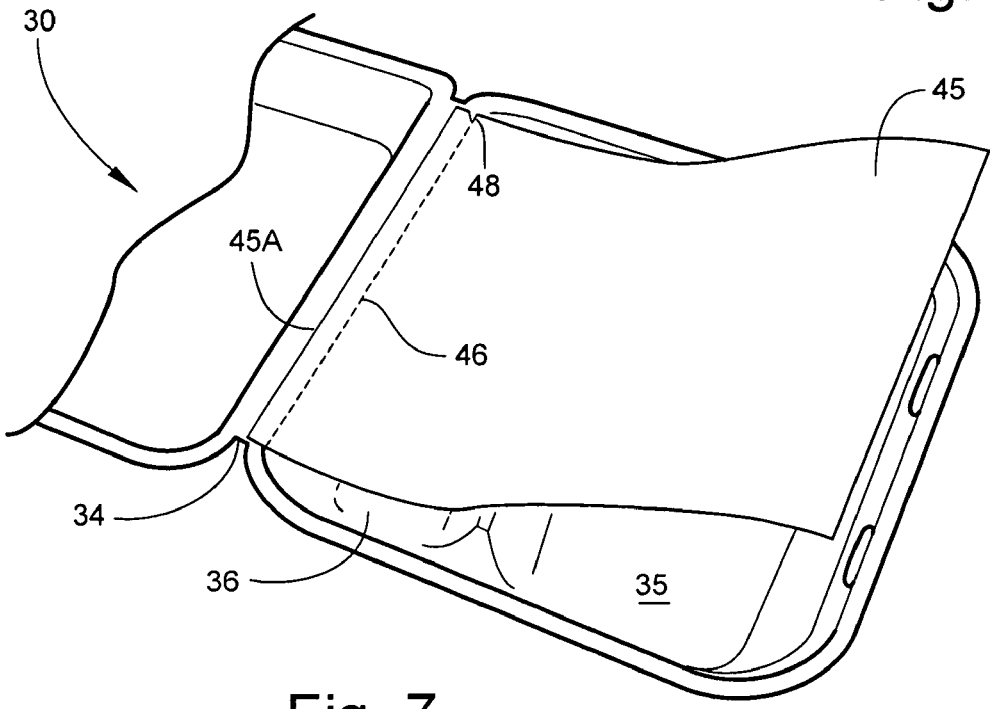
FIG. 7 is a fragmentary view of the food container shown in FIG. 5, and showing the perforated tear line attaching the wax paper sheet to the compartment tray.
Figure 8:
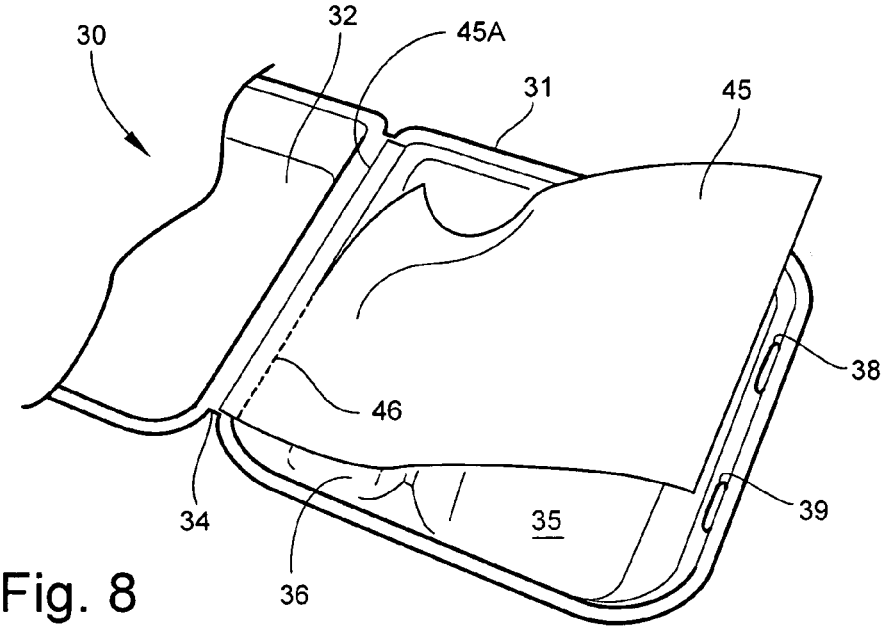
FIG. 8 is a fragmentary view of the food container showing the wax paper sheet being removed from the compartment tray.
Figure 9:
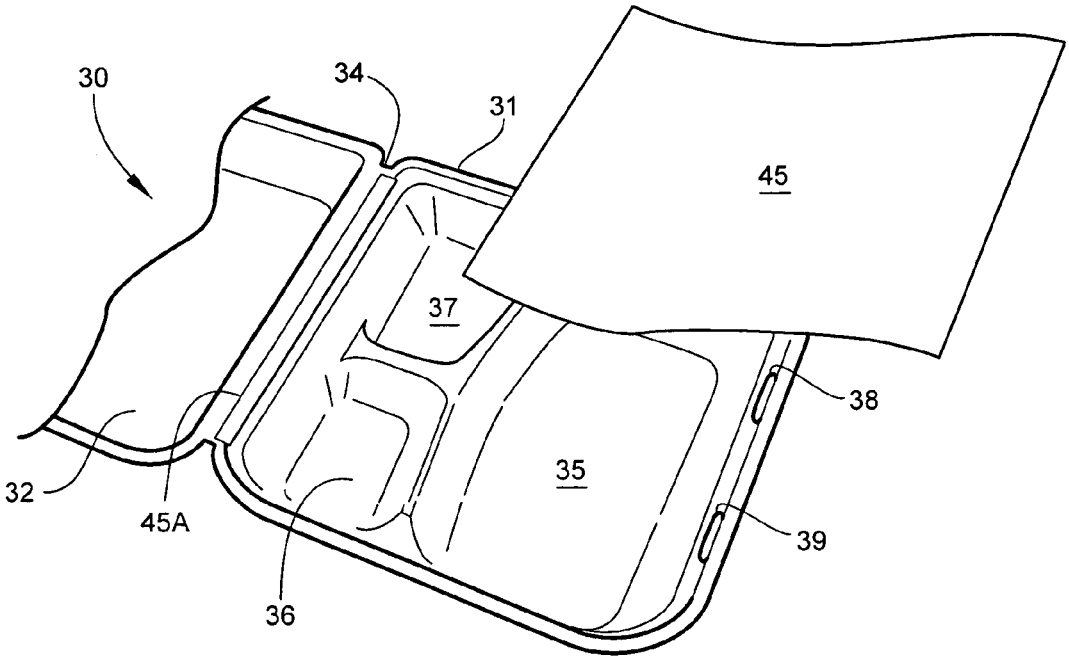
FIG. 9 is a fragmentary view of the food container with the wax paper sheet removed from the compartment tray.

A flexible sheet of dry wax paper 45 is attached to the tray 31 along the integral hinge 34. The sheet 45 defines a perforated tear line 46 extending from one side edge of the sheet 45 to the other, and spaced forward of the attached rear edge 45A. A starter nick 48, shown in FIG. 7, is formed at the leading end of the tear line 46 to facilitate tearing and removal of the sheet 45 from the container 30. By pulling the sheet 45 away from the container 30, the sheet 45 quickly and cleanly separates from the tray 31 at the tear line 46, as shown in FIG. 8. Once removed, as shown in FIG. 9, the sheet 45 can be either discarded or conveniently laid unattached over the food items placed in the tray 31.

A carry-out food container is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

I claim:

1. A carry-out food container, comprising:

(a) a food compartment tray adapted for holding a food item, and comprising four raised side edges defining an upper open end;

(b) a lid for removably covering the food item contained in said tray, and said lid comprising four side edges corresponding to the side edges of said tray, and one of the lid side edges being joined to one of the tray side edges;

(c) an integrally-formed hinge located at the joined side edges of said tray and said lid, and enabling pivoting movement of said lid relative to said tray between an open position and a closed position;

(d) a flexible sheet with a rear edge, said rear edge attached to said food container adjacent the joined side edges of said tray and said lid, and said flexible sheet adapted for residing between said tray and said lid, and said flexible sheet being unsealed at all times to said tray along a remaining three of the tray side edges, such that said flexible sheet may be readily removed at its rear edge from said tray, whereby the attachment of said flexible sheet to said food container is sufficiently strong to prevent inadvertent removal of said sheet when folding over to cover the food item, but sufficiently weak to allow intentional removal of said sheet from said food container without tearing; and (e) wherein said flexible sheet has a length and width dimension greater than a length and width dimension of said upper open end of said food compartment tray.

2. A carry-out food container according to claim 1, wherein said tray and lid are constructed of polystyrene.

3. A carry-out food container according to claim 1, wherein said tray defines a plurality of divided food compartments.

4. A carry-out food container according to claim 1, wherein said flexible sheet comprises dry wax paper.

5. A carry-out food container according to claim 4, wherein said flexible sheet is removably attached along a length of said integrally-formed hinge.

6. A carry-out food container according to claim 5, wherein said flexible sheet defines a perforated tear line extending from one side edge thereof to an opposite side edge thereof.

7. A carry-out food container according to claim 6, and comprising a starter nick formed at a leading end of said perforated tear line.

8. A carry-out food container according to claim 1, wherein said lid and tray comprise a complementary locking tab and slot, respectively, adapted for releasably holding said lid in the closed position.

* * * * *